United States Patent [19]

Zerfoss et al.

[11] 4,018,040

[45] Apr. 19, 1977

[54] STOP-MOTION FOR AUTOMATIC DOFFING APPARATUS

[75] Inventors: Clinton C. Zerfoss, Liberty; William H. Drake, Greenville, both of S.C.

[73] Assignee: Platt Saco Lowell Corporation, Easley, S.C.

[22] Filed: Sept. 26, 1975

[21] Appl. No.: 617,216

[52] U.S. Cl. ..... 57/34 R; 57/54; 221/13

[51] Int. Cl.[2] ..... D01H 9/18

[58] Field of Search ..... 57/34 R, 52, 54, 78; 221/9, 13

[56] References Cited

UNITED STATES PATENTS

| | | | |
|---|---|---|---|
| 3,024,887 | 3/1962 | Ingham, Jr. | 57/54 |
| 3,054,249 | 9/1962 | Bahnson, Jr. | 57/54 X |
| 3,082,908 | 3/1963 | Ingham, Jr. | 57/54 |
| 3,122,268 | 2/1964 | Lutz et al. | 221/13 |
| 3,410,452 | 11/1968 | Igel et al. | 221/13 |
| 3,531,016 | 9/1970 | Pray | 221/13 |
| 3,938,308 | 2/1976 | Komura et al. | 57/52 |

*Primary Examiner*—Richard C. Queisser
*Assistant Examiner*—Charles Gorenstein
*Attorney, Agent, or Firm*—Joseph H. Heard

[57] ABSTRACT

The apparatus includes a plurality of bobbin transporting members for transporting bobbins from supply sources to belt-like conveyors extending along opposite sides of a spinning machine with which the apparatus is associated. During normal operation of the apparatus, oscillatorily-movable drive means imparts continuous, synchronous oscillatory movement to the bobbin transporting members. The stop-motion promptly halts operation of the apparatus in response to significant variation in regular oscillatory movement of any of the bobbin transporting members, which variation might be caused by a bobbin-jam within the apparatus. In the preferred embodiment of the invention, the various switch elements of the stop-motion circuit are all mounted by a single bracket member for convenient positional adjustment and installation in an area of the apparatus distal from the paths of travel of the bobbins transported through the apparatus.

10 Claims, 5 Drawing Figures

STOP-MOTION FOR AUTOMATIC DOFFING APPARATUS

BACKGROUND OF THE INVENTION

This invention relates to automatic doffing apparatuses for textile spinning machines and the like, and more specifically relates to a stop-motion system for an automatic doffing apparatus having a bobbin feeding and transporting section of the general type disclosed in U.S. Pat. No. 3,870,195. Other prior United States patents of possible relevance are U.S. Pat. Nos. 3,795,343, 3,698,536, 3,601,283, 3,576,094, 3,531,016 and 3,410,452.

In an automatic doffing apparatus of the type manufactured and sold by Platt Saco Lowell Corporation, tubular bobbins are at desired times transported from supply sources, located within an end-cabinet of the spinning machine serviced by the apparatus, to upstanding peg elements upon belt-like conveyors extending along and movable longitudinally of opposite sides of such spinning machine. At each side of the apparatus, the bobbins are transported first by a cradle-like transporting member from an associated supply source to a bobbin-orienting device, and then are transported by a cage-like transporting member from the orienting device to the pegs of the associated conveyor. During normal operation of the apparatus all four of the bobbin transporting members undergo continuous oscillatory movement in synchronous relationship to each other, to an oscillatorily-drive member, and to the two conveyors of the apparatus. Such mode of operation is more fully described, with respect to the components adjacent one side of the doffing apparatus, in previously-mentioned U.S. Pat. No. 3,870,195.

There are significant advantages inherent in operation of an apparatus of the described type on a continuous-movement basis, as opposed to an intermittent-movement basis. Certain automatic doffing apparatuses which operate on an intermittent-movement basis employ the use of the one or more switch elements positioned closely adjacent the paths of travel of the bobbins being transported, and actuable by such bobbins. This is undesirable, and the continuous-movement apparatus of the type presently in question neither requires nor employs any switch elements actuable by the bobbins being transported. Additionally, an apparatus of the present continuous-movement type performs its bobbin transporting functions more efficiently and rapidly than one which operates on an intermittent-movement basis. On the other hand, the rapidity of operation of an apparatus of the subject type also makes it highly desirable that such operation be promptly halted if for any reason there should be a significant variation in the regular, synchronous oscillatory movement of one or more of the bobbin transporting members. Such a variation in the movement of one of the transporting members might be occasioned by either malfunction of a component of the apparatus or, as would more normally be the case, by a blockage caused by a bobbin-jam within the apparatus. In the case of either eventuality, prompt cessation of the operation of the apparatus is highly desirable in order to prevent possible structural damage to its components and in order to minimize the time and manual effort required to restore the apparatus to its normal operating conditions and status.

OBJECTS OF THE INVENTION

The primary object of the present invention is the provision of an improved stop-motion system, in association with a bobbin doffing apparatus of the described type, for promptly halting operation of the apparatus in response to significant variation in the regular oscillatory movement of one or more of the bobbin transporting members of such apparatus.

Another object is the provision of a stop-motion system, of the general type indicated above, which is not dependent upon and does not include switch elements actuable by the bobbins being transported by the apparatus, and which therefore cannot in any way impede the passage of such bobbins through the apparatus.

A related and more specific object is the provision of a stop-motion system, of the previously-indicated type, having switch components which are adapted to be quickly and easily mounted as a unit at a location within the doffing apparatus distal from the path of travel of the bobbins transported therethrough, for convenient independent adjustment relative to and for actuation at desired times by structural components of the apparatus.

SUMMARY OF THE INVENTION

The present invention provides an improved stop-motion system, for a bobbin doffing apparatus of the type having bobbin transporting members oscillatorily movable during normal operation of the apparatus in regular, synchronized relationship to one another and to oscillatory drive means, for promptly halting operation of the apparatus in response to significant variation in the regular oscillatory movement of any of the bobbin transporting members.

In an illustrative embodiment of the invention hereinafter described in detail, the stop-motion system comprises a plurality of switch elements carrried by a single bracket member for convenient and readily-adjustable mounting upon the frame of the apparatus at a location distal from the path of travel of the bobbins transported therethrough. During each cycle or stroke of normal oscillatory movement of the apparatus, first and second ones of the aforesaid switches are actuated in unison with one another and at one end of such stroke by respective first and second ones of the bobbin transporting members, while a third one of such switches is actuated at the opposite end of each such stroke by the drive member of the apparatus. The switches comprise part of an electrical stop-motion circuit which remains dormant for so long as all of the switches are periodically actuated at regular time intervals consonant with continued oscillatory movement of the transporting members and the drive member in regular, synchronized relationship to one another. However, upon substantial variation in the regular oscillatory movement of any of the aforesaid members, and the ensuing non-actuation or delayed actuation of the particular switch element associated with such member, the stop-motion circuit activates and halts operation of the apparatus. The foregoing result is achieved with desirable promptness and usually within less time than is required for the apparatus to complete one full stroke or cycle of normal operation.

DESCRIPTION OF THE DRAWINGS

Other features and advantages of the invention will be apparent from the following description of an illustrative embodiment thereof, which should be read in conjunction with the accompanying drawings, in which.

DESCRIPTION OF THE PREFERRED EMBODIMENT

Figure 1:
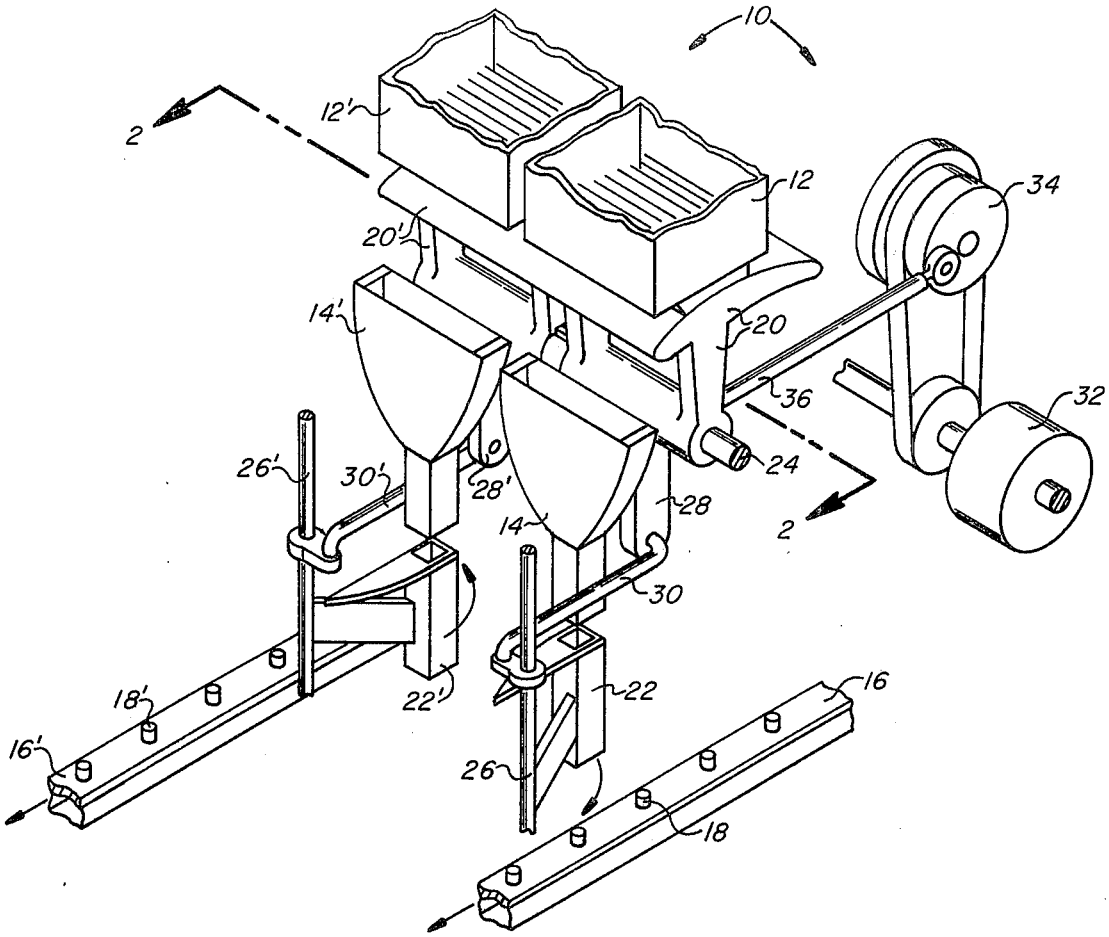
FIG. 1 is a partially schematic perspective view of that portion of an automatic doffing apparatus in association with which a stop-motion in accordance with the invention is adapted for use.

FIG. 1 of the drawings shows in partially-schematic form a portion of an automatic doffing apparatus 10 for a textile spinning machine (not shown). Of the illustrated components of apparatus 10, those on one side thereof include hopper-like bobbin supply means 12; generally funnel-shaped bobbin orienting means 14; belt-like bobbin conveyor means 16 having upstanding bobbin-receiving pegs 18 thereon; and bobbin transporting means including a cradle-like bobbin transporting member 20 for transporting individual bobbins from supply means 12 to the upper end of orienting means 14, and a cage-like transporting member 22 for transporting individual bobbins from the lower end of orienting means 14 to desired ones of the pegs 18 of conveyor 16. Transporting member 20 is mounted for oscillatory pivotal movement, about the generally-horizontally extending axis of a supporting shaft 24, between a generally upright bobbin-receiving position shown in FIG. 1 and wherein the upper portion of member 20 underlies hopper 12, and an inclined bobbin-discharging position wherein the upper portion of member 20 is disposed adjacent orienting means 14. Cage-like transporting member 22 is mounted for oscillatory pivotal movement in unison with and about the generally vertically-extending axis of a support shaft 26 between a bobbin-receiving position, shown in FIG. 1 and wherein member 22 underlies orienting means 14, and a bobbin-discharging position wherein member 22 overlies conveyor 16. Transporting members 20,22 are interconnected for oscillatory movement in unison with each by means including (see also FIG. 2) a lever-like member 28 depending downwardly from that portion of member 20 encircling supporting shaft 24, and a rod-like member 30 interconnecting lever 28 and the pivot shaft 26 supporting transporting member 22.

Except in the case of support shaft 24, components corresponding to all of those previously described upon one side of apparatus 10 are also provided upon the opposite side of the apparatus, and are identified in the drawings by corresponding reference numerals with the addition of a prime designation thereto. Support shaft 24 extends across substantially the entire width of apparatus 10 and supports both cradle-like transporting members 20,20', in spaced adjacent relationship to each other, for oscillatory pivotal movement about its axis.

Apparatus 10 further includes drive means for imparting, at desired times during normal operation of the apparatus, continuous synchronous movement to bobbin transporting members 20,20',22,22' and conveyors 16,16'. Such drive means includes a drive motor 32 having an output shaft which is operatively connected in any suitable manner (not shown) to conveyors 16,16'. The output shaft of motor 32 is also drivably connected to an eccentric crank member 34 connected by a rod 36 (see also FIG. 2) to the lower end portion of a lever-like member 38 secured at its upper end portion to shaft 24 intermediate the transporting members 20,20' supported by such shaft. Releasable detent devices 40,40' (FIG. 2) of the spring-biased seated-ball type are respectively carried by transporting members 20,20' and respectively engage opposite side faces of lever member 38. Detent members 40,40' normally secure the respective transporting members 20,20' to lever 38 for oscillatory movement in unison therewith. If the free oscillatory movement of either transporting member 20 or 20'should be significantly impeded, however, as by reason of either of such members or its interconnected transporting member 22 or 22' encountering a jammed bobbin within apparatus 10, the detent 40 or 40' carried by the affected transporting member 20 or 20' should and normally would release and thus free such member 20 or 20' from the direct driving influence of lever 38.

During normal bobbin-transporting operation of apparatus 10, motor 32 drives conveyors 16,16' continuously at substantially constant speeds in the direction of the arrows of FIG. 1, and simultaneously imparts continuous rotary movement to crank member 34. Crank member 34 in turn imparts continuous oscillatory movement to rod 36 and lever 38 which, in turn and through detent members 40,40' causes continuous synchronous oscillatory movement of transporting members 20,20' about the axis of support shaft 26. Continuous and synchronous oscillatory movement of cage-like transporting members 22,22'about the axes of their respective supporting shafts 24,24' simultaneously ensues by reason of the previously-described connections between such shafts and transporting members 20,20', respectively.

The hereinbefore described structure and mode of operation of apparatus 10 are conventional, and reference may be made to U.S. Pat. No. 3,870,195, among other sources, for a more detailed disclosure thereof.

Operation of apparatus 10 in the hereinbefore described manner normally effects rapid and efficient transportation of bobbins from supply hoppers 14,14' to conveyors 16,16' when such bobbins are all of a proper size and condition. Occasionally, however, there may be introduced into apparatus 10 a bobbin which is defective due to its being of improper size, or broken, or having yarn wound thereon. Such a defective bobbin may well "jam" at some point during its passage through apparatus 10, and thus directly or indirectly create a blockage impeding the regular oscillatory movement of the bobbin transporting members 20,22 or 20',22' on that side of the apparatus at which the jam occurs. When such an occurrence happens, the detent means 40 or 40′ (FIG. 2) on the affected side of apparatus 10 should and ordinarily will automatically release, so as to interrupt the positive drive-input from lever member 38 to the transporting member 20 or 20′ carrying the aforesaid detent means, before any structural damage to apparatus 10 ensues. Even assuming that such desirable result transpires, however, it will be noted that the conveyor 16 or 16′ on the affected side of apparatus 10, and all of the previously-described components on the opposite side of the apparatus will (but for the hereinafter-described stop-motion system of the present invention) continue in operation. A significant period of time may therefore elapse before detection of the malfunction by an attendant, particularly if he happens not to be on that particular side of apparatus 10 affected by the malfunction. During such period of time an appreciable number of the pegs 18 or 18′ upon the conveyor 16 or 16′ at the affected side of apparatus 10 will pass by the associated transporting member 22 or 22′ without receiving bobbins thereon. This is undesirable since it necessitates that the attendant, after finally recognizing the existance of the malfunction and correcting the cause thereof, also manually place bobbins upon those conveyor pegs 18 or 18′ upon which bobbins should have been but were not automatically placed.

Similar undesirable results would ensue from continued operation of apparatus 10 even if the significant variation in the regular oscillatory movement of one of the bobbin transporting members of the apparatus were occasioned by something other than a bobbin-jam and blockage within the apparatus, as for instance by a malfunction of one of the detents 40,40′. If one of the detents 40,40′ should inadvertently release during normal operation of apparatus 10 and when no jam is present therein, as might happen due to too loose a setting of or a component-failure within such detent, the undesirable results ensuing from then-continued operation of apparatus 10 would be the same as those described above. If the improper operation of one of the detents 40,40′should take the form of its failing to release in response to a blockage within apparatus 10, even more serious consequences could of course then result from continued operation of apparatus 10.

The possibility of the foregoing undesirable results occurring are minimized, if not altogether obviated, by the stop-motion system of the present invention. Such stop-motion system reliably and promptly halts operation of all the prepreviously discussed components of apparatus 10 in response to a significant variation in the regular synchronous movement of any of the bobbin transporting members 20,20′,22,22′, irrespective of whether the movement-variation is occasioned by a jam or blockage within apparatus 10 or by some other cause.

Figure 2:
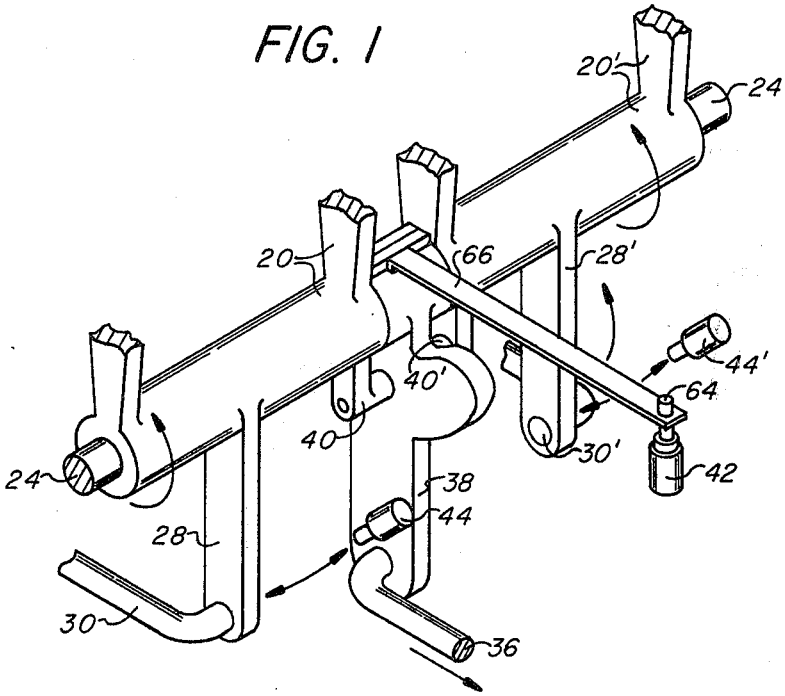
FIG. 2 is an enlarged fragmentary perspective view of fragmentary portions of certain of the apparatus components shown in FIG. 1, as viewed in the direction of the arrows 2—2 of FIG. 1, and also showing in partially-schematic form the switch elements of the present stop-motion.
Figure 4:
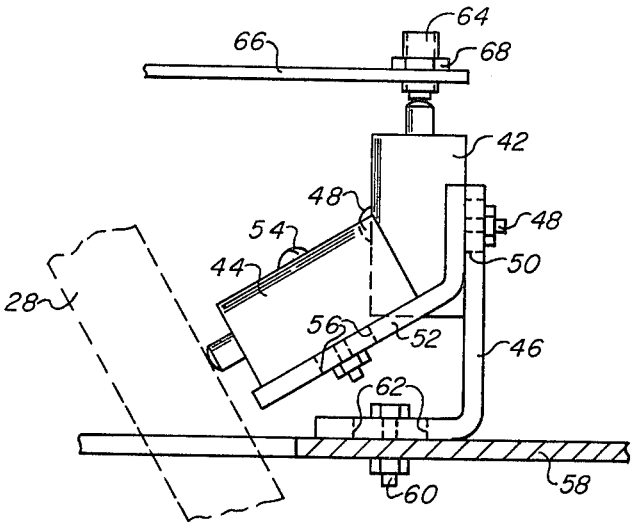
FIG. 4 is an enlarged side elevational view of the switch elements and mounting bracket of FIG. 3, with frame and switch-actuating components of the doffing apparatus also being fragmentarily shown.
Figure 3:
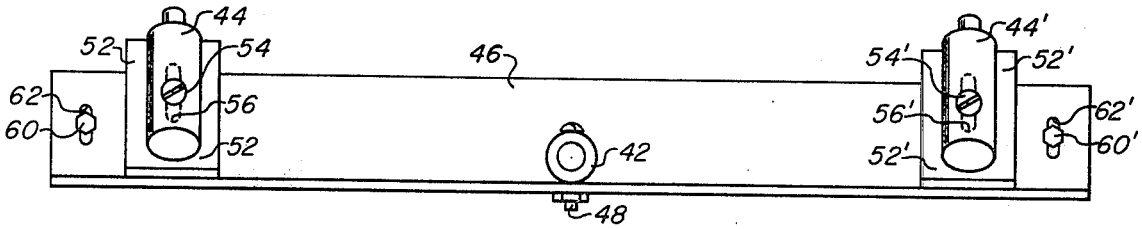
FIG. 3 is a top plan view of the stop-motion switch elements, and the mounting bracket therefor.

Referring now particularly to FIGS. 3 and 4, the preferred embodiment of the present stop-motion system includes a plurality of generally cylindrically-shaped switch elements 42,44,44′ which preferably and illustratively are all carried by a single elongate bracket member 46 of generally L-shaped cross-sectional configuration. Switch 42 extends vertically upwardly from the center portion of bracket 46, and is mounted for vertical adjustive movement by a bolt 48 which extends through the switch housing and through a slot-like opening 50 (FIG. 4) provided in the upstanding portion of bracket 46. Switches 44,44′ are respectively supported upon forwardly and downwardly inclined arms 52,52′ provided upon bracket 46 adjacent opposite ends thereof, and are mounted for independent longitudinal adjustment by bolts 54,54′ which extend through respective ones of the switch housings and through slot-like openings 56,56′ within arms 52,52′. Bracket 46 is itself supported upon a horizontally-extending frame portion 58 (FIG. 4) of apparatus 10 disposed distal from the paths of travel of the bobbins transported through the apparatus, such frame portion 58 being below and to the rear of support shaft 24 (FIGS. 1 and 2) of the apparatus. Bolts 60,60′ extending through slot-like openings 62,62′ provided within opposite end portions of bracket 46 secure the bracket to frame 58 and permit convenient forward-rearward positional adjustment of the bracket and of all of the switches carried by it, in unison with each other, when desired.

When switches 42,44,44′ are mounted as aforesaid in their proper operating positions, switches 44,44′ are respectively actuated, simultaneously with each other and at regular periodic times during normal operation of apparatus 10, by the downwardly-depending levers 28,28′ of bobbin transporting members 20,20′, respectively. As is indicated by the double-headed arrows in FIG. 2 and by the phantom-line showing of lever 28 in FIG. 4, such actuation occurs at that one end of each stroke or cycle of oscillatory movement of transporting members 20,20′ when such members are inclined to their maximum extent relative to the vertical. At such time the contact elements at the forward ends of switches 44,44′ are simultaneously engaged and actuated by levers 28,28′, respectively. Switch 42 is periodically actuated, at regular intervals and in synchronous relationship to the simultaneous actuation of switches 44,44′ during normal operation of apparatus 10, at the opposite end of each stroke or cycle of the oscillatorily-movable components of the apparatus. As is indicated in FIGS. 2 and 4, actuation of switch 42 occurs at such time through engagement of the contact element at its upper end by a screw-like actuating element 64 carried at and extending through one end portion of a support arm 66 suitable affixed at its opposite end to the upper part of drive-input lever 38 for oscillatory movement in unison therewith. By loosening lock-nut means 68 associated with actuating screw 64, the extent of such screw's projection through support arm 66 can be adjusted as desired.

Figure 5:
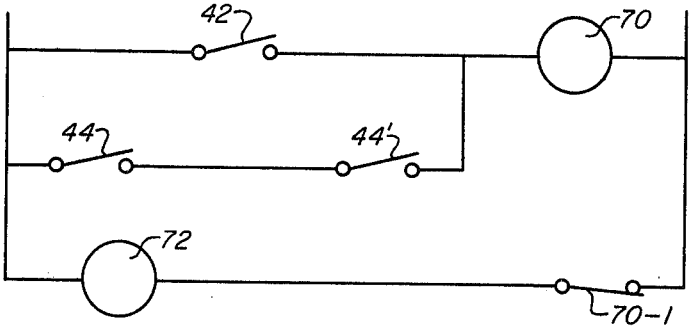
FIG. 5 is a schematic diagram of the electrical stop-motion circuit.

As is indicated in FIG. 5, to which reference should now also be made, switches 42,44,44′ are all of the normally-open type and form part of an electrical stop-motion circuit which further includes a time-delay relay 70 having a normally-closed contact 70-1 in series with a control relay 72 whose de-energization halts operation of apparatus 10, as by interrupting the power circuit (not shown) of drive motor 32 (FIG. 1). De-energization of control relay 72 may also effect activation of visual and/or audible alarm means (not shown), if desired. Switch 42 is in series with time-delay 70, and such relay is energized whenever switch 42 is momentarily actuated (i.e., closed) in the previously-described manner. Switches 44,44′ are in electrically-parallel relationship to switch 42, and in series relationship to each other and to time-delay relay 70. Relay 70 is therefore also energized whenever switches 44,44′ are simultaneously momentarily actuated (i.e., closed) in the manner previously described. Each energization of relay 70 first re-sets and then commences operation of its timer component. If not re-set within a prescribed time period after being energized, relay 70 will "time-in" and its contact 70-1 will open to de-energize control relay 72. The time period required for relay 70 to thus time-in is slightly more than one-half of the time required for the oscillatorily-movable components of apparatus 10, to complete, during normal operation of the apparatus, one full oscillatory stroke or cycle of movement. If for example one full stroke or cycle of oscillatory movement of its components were completed every four seconds during normal operation of apparatus 10, relay 70 would time-in at the end of, say, the third second following each energization thereof, unless eariler re-set by another energization thereof.

It will be apparent that during normal operation of apparatus 10, when bobbin transporting members 20,20',22,22'and drive input member 38 all move in regular synchronous relationship to each other, relay 70 will never time-in since such relay will be regularly re-set, at time intervals of lesser duration than that required for timing-in to occur, by momentary energizations thereof at opposite ends of each stroke or cycle of oscillatory movement of the aforesaid members. However, if there should be a significant variation in the regular oscillatory movement of any of the bobbin transporting members of apparatus 10, relay 70 would time-in to promptly halt operation of apparatus 10. Thus, assume for purposes of illustration that the components of apparatus 10 occupy their end-stroke positions shown in FIGS. 1 and 2, wherein switch 42 has just been actuated. If upon commencement of the next cycle of operation detent member 40 (FIG. 2) should release, due either to malfunction of such detent member or in response to transporting member 20 or 22 encountering a bobbin-jam or blockage within the apparatus, transporting member 20 will not move in its regular synchronous manner with drive-input member 38 or transporting member 20'. At the opposite end of the aforesaid stroke or cycle of oscillatory movement, switch 44 will therefore not be actuated in unison with switch 44' and relay 70 will therefore not be re-set. Relay 70 will therefore time-in during and before completion of the remaining portion of the aforesaid operating cycle, causing cessation of the operation of apparatus 10. The same result, that is halting of the operation of apparatus 10 within usually less time than is required for its completion of a single oscillatory stroke or cycle of operation, would transpire if the assumed release of detent member 40 occurred during the other one-half of any cycle of operation of the apparatus, or if it were the other detent member 40', rather than the detent member 40, which released. It will also be apparent that the stop-motion would similarly be activated if, upon a blockage occurring in apparatus, the appropriate one of the detent members 40,40' failed to release and a "stalled" condition ensued. Relay 70 would time-in in such a case irrespective of whether it was switch 42 or switches 44,44' which underwent the last actuation prior to the stall condition arising.

While an illustrative embodiment of the invention has been specifically shown and described, this was for purposes of illustration only, and not for purposes of limitation, the scope of the invention being in accordance with the following claims.

That which is claimed is:

1. In an automatic doffing apparatus for a textile spinning machine, said apparatus including bobbin supply means, bobbin conveyor means, and bobbin transporting means for transporting bobbins from said supply means and to said conveyor means, said bobbin transporting means being oscillatorily movable between bobbin receiving and bobbin discharging positions substantially continuously during normal operation of said apparatus, the improvement comprising:

switch means including a switch element mounted adjacent the path of oscillatory movement of said bobbin transporting means for regular periodic actuation by said bobbin transporting means during normal operation of said apparatus;

and stop-motion circuit means including said switch means for halting operation of said apparatus in response to significant variation in the regular periodic actuation of said switch element by said bobbin transporting means.

2. Apparatus as in claim 1, wherein said bobbin transporting means includes first and second bobbin transporting members, and wherein said switch means includes said first-mentioned switch element and a second switch element, said first and second switch elements being respectively mounted adjacent said first and second bobbin transporting members for said regular periodic actuation respectively thereby during normal operation of said apparatus, and wherein said circuit means halts operation of said apparatus in response to significant variation in the regular periodic actuation of either of said switch elements.

3. Apparatus as in claim 1, and further including oscillatorily-movable drive means operatively connected to said bobbin transporting means and during normal operation of said apparatus imparting said movement to said bobbin transporting means in synchronized relationship to oscillatory movement of said drive means, and wherein said switch means includes said first-mentioned switch element actuable by said bobbin transporting means, and at least one other switch element periodically actuable by said drive means during normal operation of said apparatus in regular synchronous relationship relative to said actuation of said first switch element, and wherein said circuit means halts operation of said apparatus in response to significant variation in the regular synchronous actuation of said switch elements relative to each other.

4. Apparatus as in claim 3, wherein said bobbin transporting means includes first and second bobbin transporting members, said first switch element being mounted adjacent said first bobbin transporting member for said actuation thereby during normal operation of said apparatus, and said switch means further including a second switch element mounted adjacent said second bobbin transporting member for actuation thereby during normal operation of said apparatus in regular synchronous relationship relative to said actuation of said first switch element and said other switch element, and wherein said circuit means halts operation of said apparatus in response to significant variation in the regular synchronous actuation of any of said switch elements relative to each other.

5. Apparatus as in claim 4, wherein during each cycle of normal operation of said apparatus, said first and second switch elements are actuated simultaneously with each other and at a different time for actuation of said other switch element.

6. Apparatus as in claim 4, including a supporting frame, and mounting means mounting all of said switch elements upon said frame for positional adjustment of all of said switch elements in unison with each other relative to said frame and for independent positional adjustment of at least one of said switch elements relative to at least one other of said switch elements.

7. Apparatus as in claim 6, wherein said mounting means comprises a bracket member, means mounting said bracket member upon said frame for positional adjustment relative to said frame, and means mounting said switch elements upon said bracket member for positional adjustment in unison therewith relative to said frame and for independent positional adjustment of at least said first and second switch elements relative to each other and to said bracket member.

8. Apparatus as in claim 1, and further including bobbin-orienting means positioned intermediate said bobbin supply means and said bobbin conveyor means, and wherein said bobbin transporting means includes an upstanding cradle-like member for transporting bobbins from said bobbin supply means to said bobbin orienting means, and a cage-like member for transporting bobbins from said bobbin orienting means to said bobbin conveyor means, and a generally horizontally-extending support shaft mounting said upstanding cradle-like member intermediate its heigth for oscillatory pivotal movement about the axis of said shaft during normal operation of said apparatus, said cradle-like member having a bobbin-receiving portion adjacent the upper end thereof and above said supporting shaft, and said switch element being mounted adjacent and actuable by a portion of said cradle-like member disposed below said supporting shaft and distal from the paths of travel of the bobbins transported through said apparatus.

9. In an automatic doffing apparatus for a textile spinning machine, said apparatus including bobbin supply means, bobbin conveyor means, bobbin transporting means for transporting bobbins from said bobbin supply means to said bobbin conveyor means, and oscillatorily-movable drive means connected to said bobbin transporting means for during each cycle of normal operation of said apparatus imparting continuous oscillatory movement to said bobbin transporting means in synchronous relationship to continuous oscillatory movement of said drive means, the improvement comprising;

switch means including a plurality of switch elements adapted during each cycle of normal oscillatory operation of said apparatus to be periodically actuated in regular synchronous relationship relative to each other, at least one of said switch elements being mounted adjacent said bobbin transporting means for said periodic actuation thereby, and at least one other of said switch elements being mounted adjacent said drive means for said periodic actuation thereby;

a stop-motion circuit means including said switch means for halting operation of said apparatus in response to significant variation in the regular synchronous actuation of said switch elements relative to each other.

10. In an automatic doffing apparatus for a textile spinning machine, said apparatus bobbin supply means, bobbin conveyor means, bobbin transporting means for during normal operation of said apparatus transporting bobbins from said supply means to said conveyor means, oscillatorily-movable drive means operable continuously during normal operation of said apparatus, and detent means releasably connecting said bobbin transporting means to said drive means for continuous oscillatory movement of said bobbin transporting means in unison with said drive means during normal operation of said apparatus, said detent means releasing at those times during operation of said apparatus when said oscillatory movement of said bobbin transporting means is significantly impeded to then permit relative movement between said drive means and said bobbin transporting means, the improvement comprising:

switch means operatively associated with said bobbin transporting means and said drive means;

and stop-motion circuit means including said switch means for halting operation of said apparatus at said times when said detent means releases to permit relative movement between said drive means and said bobbin transporting means.

* * * * *

UNITED STATES PATENT AND TRADEMARK OFFICE

CERTIFICATE OF CORRECTION

PATENT NO. : 4,018,040

DATED : April 19, 1977

INVENTOR(S) : Clinton C. Zerfoss and William H. Drake

It is certified that error appears in the above-identified patent and that said Letters Patent are hereby corrected as shown below:

Col. 1, line 42, "of the one" should read -- of one --.
Col. 8, line 63, "for" should read -- from --.
Col. 10, line 19, "apparatus bobbin" should read -- apparatus including bobbin --.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*